US008814499B2

(12) United States Patent
Kim

(10) Patent No.: US 8,814,499 B2
(45) Date of Patent: Aug. 26, 2014

(54) CENTRIFUGAL COMPRESSOR

(75) Inventor: Chun Kyung Kim, Busan (KR)

(73) Assignee: Korea Fluid Machinery Co., Ltd., Yangsan, Gyoung-nam (KR)

( * ) Notice: Subject to any disclaimer, the term of this patent is extended or adjusted under 35 U.S.C. 154(b) by 509 days.

(21) Appl. No.: 13/048,261

(22) Filed: Mar. 15, 2011

(65) Prior Publication Data

US 2011/0255963 A1 Oct. 20, 2011

(30) Foreign Application Priority Data

Apr. 19, 2010 (KR) ..... 10-2010-0035681
Apr. 19, 2010 (KR) ..... 10-2010-0035682

(51) Int. Cl.
*F04D 29/051* (2006.01)

(52) U.S. Cl.
CPC ..... *F04D 29/0516* (2013.01)
USPC ..... 415/58.4; 415/145

(58) Field of Classification Search
CPC . F04D 27/0207; F04D 27/0215; F04D 27/02; F04D 29/051; F04D 29/052
USPC ..... 415/145, 58.4, 206, 180; 417/307, 173; 60/602; 384/107, 317, 380, 372
See application file for complete search history.

(56) References Cited

U.S. PATENT DOCUMENTS 1,959,451 A * 5/1934 Vogel-Jorgensen ..... 384/313
2,173,489 A * 9/1939 Voigt ..... 384/320
2,470,565 A * 5/1949 Loss ..... 415/27
2,656,096 A * 10/1953 Schwarz ..... 417/323
2,732,125 A * 1/1956 Ruby ..... 415/27
2,798,657 A * 7/1957 Darrow ..... 415/49
2,930,520 A * 3/1960 Abild ..... 415/17
3,204,562 A * 9/1965 Norquist ..... 415/57.1
3,257,957 A * 6/1966 Tracy ..... 415/112
3,362,629 A * 1/1968 Papapanu ..... 415/200
RE26,570 E * 4/1969 Dunn ..... 184/109
3,588,266 A * 6/1971 Bulkington ..... 415/11
3,901,620 A * 8/1975 Boyce ..... 415/1
3,936,379 A * 2/1976 McCabe ..... 210/131
3,966,351 A * 6/1976 Sproule ..... 415/110
4,236,867 A * 12/1980 Morris ..... 415/26
4,254,625 A * 3/1981 Bergstedt et al. ..... 60/602
4,259,840 A * 4/1981 Tenney ..... 60/602
4,265,589 A * 5/1981 Watson et al. ..... 415/47
4,574,585 A * 3/1986 Conn ..... 60/795
4,653,978 A * 3/1987 Eberhardt et al. ..... 415/39
4,725,206 A * 2/1988 Glaser et al. ..... 417/407
4,786,238 A * 11/1988 Glaser et al. ..... 417/53
5,113,670 A * 5/1992 McAuliffe et al. ..... 62/402
RE34,276 E * 6/1993 Glaser et al. ..... 417/407
5,605,045 A * 2/1997 Halimi et al. ..... 60/607

(Continued)

*Primary Examiner* — Edward Look
*Assistant Examiner* — Eldon Brockman
(74) *Attorney, Agent, or Firm* — Sherr & Jiang, PLLC

(57) ABSTRACT

Provided is a centrifugal compressor having improved operation performance to improve durability. The centrifugal compressor includes an impeller connected to a rotary shaft and configured to radially eject a fluid suctioned in an axial direction upon rotation thereof; a shroud configured to cover front and rear sides of the impeller and having a suction port formed to face one surface of the impeller at a center of one side thereof; a volute chamber formed at an outer periphery of the shroud in a circumferential direction thereof and configured to guide the fluid ejected by the impeller to an ejection port; and a regulator installed at one side of the shroud and configured to selectively communicate a space formed at the other surface of the impeller with the outside.

4 Claims, 5 Drawing Sheets

(56) References Cited

U.S. PATENT DOCUMENTS

| | | | | |
|---|---|---|---|---|
| 5,683,223 | A * | 11/1997 | Harada et al. | 415/17 |
| 5,827,040 | A * | 10/1998 | Bosley et al. | 415/106 |
| 6,094,799 | A * | 8/2000 | Stewart et al. | 29/525 |
| 6,296,441 | B1 * | 10/2001 | Gozdawa | 415/180 |
| 6,499,969 | B1 * | 12/2002 | Tombers et al. | 417/407 |
| 6,932,563 | B2 * | 8/2005 | Cabrales et al. | 415/58.4 |
| 7,069,728 | B2 * | 7/2006 | Bruno et al. | 60/785 |
| 7,094,016 | B1 * | 8/2006 | Zaher | 415/1 |
| 7,210,295 | B2 * | 5/2007 | McEwen | 60/602 |
| 7,244,095 | B2 * | 7/2007 | Hays | 415/84 |
| 7,267,523 | B2 * | 9/2007 | Saville | 415/1 |
| 7,326,027 | B1 * | 2/2008 | Skoch et al. | 415/17 |
| 8,113,770 | B2 * | 2/2012 | Lombard et al. | 415/166 |
| 8,287,233 | B2 * | 10/2012 | Chen | 415/58.4 |
| 8,353,664 | B2 * | 1/2013 | Lombard et al. | 415/145 |
| 2002/0069645 | A1 * | 6/2002 | Mowill | 60/776 |
| 2004/0223843 | A1 * | 11/2004 | Cabrales et al. | 415/58.4 |
| 2005/0056013 | A1 * | 3/2005 | Furman et al. | 60/602 |
| 2007/0224032 | A1 * | 9/2007 | Gu et al. | 415/58.4 |
| 2008/0031750 | A1 * | 2/2008 | Gomilar et al. | 417/409 |
| 2009/0028694 | A1 * | 1/2009 | Naemura et al. | 415/145 |
| 2009/0191048 | A1 * | 7/2009 | Berger et al. | 415/145 |
| 2009/0317026 | A1 * | 12/2009 | Hanano | 384/372 |
| 2010/0011779 | A1 * | 1/2010 | Senior | 60/785 |
| 2012/0128470 | A1 * | 5/2012 | Goodman et al. | 415/145 |

* cited by examiner

CENTRIFUGAL COMPRESSOR

This application claims the benefit of Korean Application Nos. 10-2010-35681 and 10-2010-35682 which were filed on Apr. 19, 2010, which were hereby incorporated by reference as if fully set forth herein.

BACKGROUND OF THE INVENTION

1. Field of the Invention

The present invention relates to a centrifugal compressor, and more particularly, to a centrifugal compressor having an improved operation structure to improve durability and bearing-support performance.

2. Background of the Related Art

In general, a centrifugal compressor is an apparatus for compressing and pumping a fluid by suctioning the fluid in an axial direction of a rotating impeller and ejecting the fluid in a circumferential direction thereof.

FIG. 1 is a front view of a conventional centrifugal compressor, and FIG. 2 is a side cross-sectional view of a structure of the conventional centrifugal compressor. As shown in FIGS. 1 and 2, the conventional centrifugal compressor includes a rotary shaft 11, an impeller 20, a shroud 30 and a volute chamber 40.

Here, the impeller 20 is connected to the rotary shaft 11 connected to a motor to be rotated. Accordingly, a fluid is suctioned in an axial direction of the impeller 20 through a suction port 10 to be ejected in a radial direction. In addition, the shroud 30 is disposed to surround the impeller 20, and the ejected fluid is collected in the volute chamber 40 disposed in a circumferential direction of the shroud 20.

Here, the impeller 20 is provided by separately assembling front and rear members.

In addition, one surface 21 of the impeller 20 includes a plurality of blades 20*a* having a rounded cross-section and configured to be rotated to suction a fluid. As the impeller 20 is rotated in an arrow direction shown in FIG. 1, the fluid in contact with the one surface 21 is accelerated to be centrifugally compressed and ejected in a radial direction. The fluid accelerated as described above is guided by the shroud 30 to be radially ejected, and the ejected fluid is collected in the volute chamber 40 having a ring shape and disposed at a circumferential end of the shroud 30.

The fluid collected in the volute chamber 40 is moved along the volute chamber 40 with inertia in a rotating direction of the impeller 20 and then ejected through an ejection port 45. Here, a cross-section of the volute chamber 40 is configured to increase in the rotating direction of the moving fluid.

As described above, as the impeller 20 is rotated to suction the fluid through the suction port 10, and press and eject the fluid through the ejection port 15 using a centrifugal force, continuously performing compression and pumping operations of the fluid through the centrifugal compressor.

Meanwhile, since the fluid at the one surface 21 of the impeller 20 is accelerated by the centrifugal force to lower a pressure, the pressure at the one surface 21 of the impeller 20 is lower than that at the other surface 22 opposite to the one surface 21. As described above, when the pressure at the one surface 21 of the impeller is lower than that at the other surface 22, an axial thrust force is applied to the other surface 22 of the impeller 20 in the arrow direction by the pressure difference. In addition, the fluid having a pressure increased through a gap between the impeller 20 and the shroud 30 is introduced in the arrow direction shown in FIGS. 1 and 2, and thus, the axial thrust force is further increased.

In order to solve the problem, as shown in FIG. 3, a conventional double suction centrifugal compressor includes impellers 20 disposed at both ends thereof. As the impellers 20 are rotated, a fluid is suctioned through suction ports 10, and compressed and ejected through ejection ports 45 by a centrifugal force, respectively. Here, in the double suction centrifugal compressor, axial thrust forces applied from the impellers 20 disposed at both ends are offset from each other.

Here, a foil-type gas bearing includes a bump foil 3 and a top foil 4 overlapping to surround the rotary shaft 11 and a thrust bearing disk 50. When the rotary shaft 11 is rotated, a dynamic pressure due to an air flow is formed in a space between the foils and the rotary shaft 11. By the dynamic pressure of the air, the foils are resiliently deformed in a direction away from the rotary shaft 11, and an air gap is formed between the rotary shaft 11 and the foils so that the rotary shaft 11 can be rotated without friction with the foils.

However, the conventional centrifugal compressor has the following problems.

First, while the axial thrust forces may be offset when the two impellers are used to offset the axial thrust forces, a resistance due to a parallel operation occurs, which decreases performance thereof.

Second, due to the axial thrust forces, the impeller may impact the shroud and cause friction to decrease durability, and vibrations caused by the impact and friction may cause noises. Here, since the axial thrust forces are further increased as the rotational speed of the impeller is increased, a support load of a thrust bearing 13 enduring the increased axial thrust forces and supporting the rotary shaft is increased, and thus, a dynamic support structure must be reinforced.

Third, a disk 50 installed in the thrust bearing 13 may cause heat generation, wearing and power loss caused by breakage of the air gap and an increase in temperature due to partial contact and friction at a concave and convex part of the top foil 5 of the thrust bearing 13 according to rotation of the rotary shaft. Since such an abrupt increase in temperature eventually decreases performance of the thrust bearing 13 so that the axial thrust forces generated at the impellers cannot be controlled, a blow off valve (BOV) 80 for removing a surging phenomenon must be provided.

Fourth, a high temperature air compressed by the impellers is partially transmitted to the volute chambers 40 as shown by arrows, and the remaining gas is transmitted to rear sides of the impellers 20 through gaps between the impellers 20 and the volute chambers 40, and then sequentially transmitted into the thrust bearings 13 and radial bearings 60 to accelerate an increase in temperature of the gas bearing, decreasing durability of the centrifugal compressor.

SUMMARY OF THE INVENTION

In order to solve the problems, it is an object of the present invention to provide a centrifugal compressor capable of improving operation performance of an impeller to increase durability by controlling an axial thrust force generated in a space of one side of the impeller upon rotation thereof.

In order to accomplish the above object, it is an aspect of the present invention to provide a centrifugal compressor including: an impeller connected to a rotary shaft and configured to radially eject a fluid suctioned in an axial direction upon rotation thereof; a shroud configured to cover front and rear sides of the impeller and having a suction port formed to face one surface of the impeller at a center of one side thereof; a volute chamber formed at an outer periphery of the shroud in a circumferential direction thereof and configured to guide the fluid ejected by the impeller to an ejection port; and a regulator installed at one side of the shroud and configured to selectively communicate a space formed at the other surface of the impeller with the outside.

It is another aspect of the present invention to provide a centrifugal compressor including: a rotary shaft having a main flow path formed therein in an axial direction thereof to be rotated; an impeller connected to one end of the rotary shaft, and configured to suction a fluid in an axial direction and eject the fluid in a radial direction; a thrust bearing disk having a thrust cooling flow path formed therein in the radial direction, and integrally formed with the other end of the rotary shaft to keep a rotation balance with the impeller; and a gas bearing including a radial bearing and a thrust bearing disposed at the rotary shaft and an outer surface of the thrust bearing disk, wherein an air gap is formed to support a rotating load.

BRIEF DESCRIPTION OF THE DRAWINGS

The above and other objects, features and advantages of the present invention will become more apparent to those of ordinary skill in the art by describing in detail example embodiments thereof with reference to the attached drawings, in which.

DETAILED DESCRIPTION OF THE PREFERRED EMBODIMENT

Figure 1:
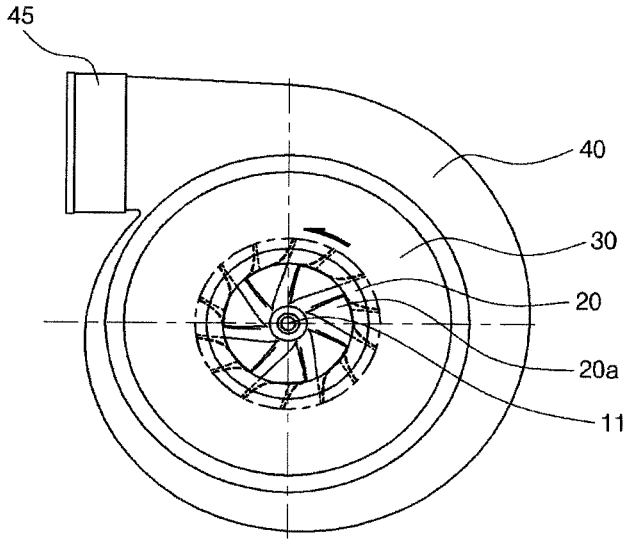
FIG. 1 is a front view of a conventional centrifugal compressor.

Hereinafter, exemplary embodiments of the present invention, in which the object can be specifically realized, will be described with reference to the accompanying drawings. In description of the embodiments, like reference numerals refer to like names and elements, and detailed description thereof will not be repeated.

Next, a centrifugal compressor in accordance with an exemplary embodiment of the present invention will be described with reference to the accompanying drawings.

Figure 4:
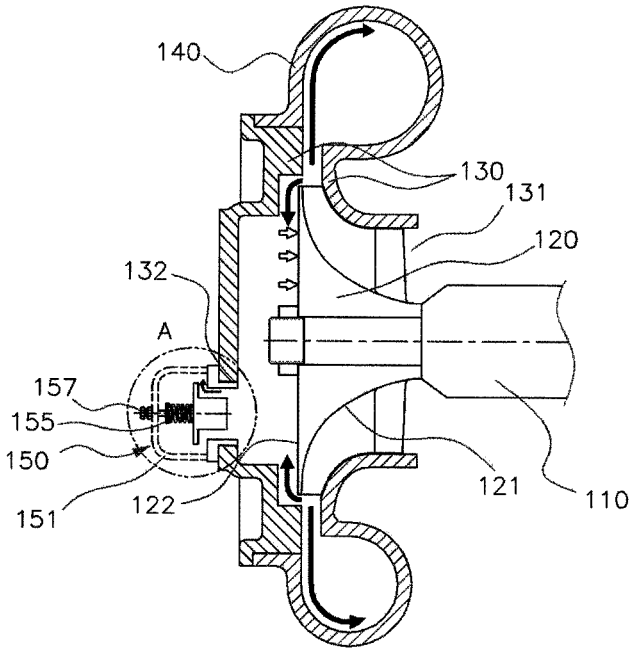
FIG. 4 is a side cross-sectional view of a centrifugal compressor in accordance with an exemplary embodiment of the present invention.
Figure 5:
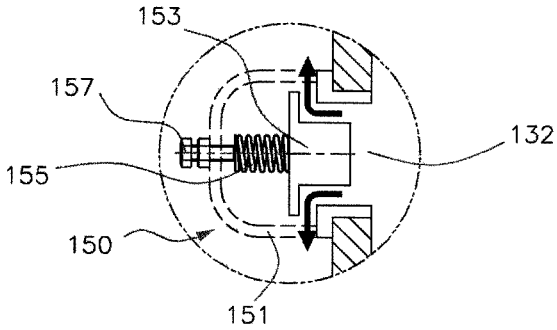
FIG. 5 is an enlarged view of a portion A of FIG. 4.

FIG. 4 is a side cross-sectional view of a centrifugal compressor in accordance with an exemplary embodiment of the present invention, and FIG. 5 is an enlarged view of a portion A of FIG. 4.

As shown in FIGS. 4 and 5, the centrifugal compressor in accordance with an exemplary embodiment of the present invention includes an impeller 120, a shroud 130, a volute chamber 140 and a regulator 150. Here, the centrifugal compressor refers to an apparatus including a centrifugal pump or a centrifugal blower and compressing a fluid using a centrifugal force to eject the fluid at an increase pressure.

Specifically, the impeller 120 includes a plurality of blades 20*a* (see FIG. 1) having a rounded cross-section configured to be rotated to suction a fluid, and is connected to a motor, which is operated upon supply of power, through a rotary shaft 110. The impeller 120 is rotated to suction the fluid in an axial direction and eject the fluid in a radial direction.

For this, a magnet (not shown) is installed at an outer surface or in the inside of the rotary shaft 110, and the rotary shaft 110 is rotated at a high speed by a rotating magnetic field caused by current when the current flows through a stator (not shown) spaced apart from the magnet. For this, the stator is disposed at an outside of the magnet to generate the rotating magnetic field on the magnet, and a casing (not shown) is installed at the outside. An air gap of the rotary shaft 110 is formed such that a gas bearing is disposed to support a rotating load.

Here, the casing is hollow such that a body of a high speed electric motor is constituted by the casing and various elements are accommodated therein. The stator formed by stacking a plurality of thin plates and having a coil-type winding is fixed to the inside of the casing, and the rotary shaft 110 is rotated by the rotating magnetic field formed between the stator and the rotary shaft 110. In addition, the gas bearing is coupled to and supported by the casing.

Of course, rotation of the rotary shaft 110 is not limited thereto but may be performed by being connected to a motor to which power is supplied.

Meanwhile, the shroud 130 is configured to guide movement of the fluid suctioned by the impeller 120 and cover front and rear sides of the impeller 120, and may be constituted by assembling separate front and rear members. A suction port 131 is formed at a center of one open side of the shroud 130 to suction a fluid, and one surface of the impeller 120 is disposed to face the suction port 131.

Therefore, as the impeller 120 is rotated in the arrow direction shown in FIG. 1, the fluid in contact with one surface 121 of the impeller 120 is accelerated to be compressed by a centrifugal force and ejected in a radial direction.

Specifically, the suction port 131 of the impeller 120 is formed around the rotary shaft 110 concentrically coupled to the center of the one open side of the shroud 130 to have a suction direction different from that of the conventional centrifugal compressor. Accordingly, bad influence on the thrust bearing 13 (see FIG. 2) caused by introduction of the high pressure and high temperature fluid from the conventional centrifugal compressor toward the rotary shaft can be prevented.

Meanwhile, the fluid accelerated by the impeller 120 and ejected in the radial direction is guided by the shroud 130, and collected in the volute chamber 140 disposed at a circumferential end of the shroud 130 and having a ring shape.

The volute chamber 140 is installed at an outer periphery of the shroud 130 in the circumferential direction to guide the fluid passing through the impeller 120 and ejected in the radial direction to the ejection port 45 (see FIG. 1).

Therefore, the fluid collected in the volute chamber 140 having inertia in the same rotating direction as the impeller 120 is moved along the volute chamber 140 to be ejected through the ejection port. Here, a cross-sectional area of the volute chamber 140 is configured to increase in the rotating direction of the moving fluid.

As described above, the fluid suctioned through the suction port according to rotation of the impeller 120 is compressed by the centrifugal force to be flowed along the volute chamber 140 and then ejected through the ejection port, and thus, the centrifugal compressor can continuously perform compression and pumping of the fluid.

Meanwhile, the regulator 150 configured to selectively communicate the space formed adjacent to the other surface 122 of the impeller 120 with the outside is installed at one side of the shroud 130.

Here, the regulator 150 discharges the increased pressure introduced into the space formed adjacent to the other surface 122 of the impeller 120 to the outside. Accordingly, the centrifugal compressor in accordance with the present invention can remove the axial thrust force, which may be generated from the outer surface 122 of the impeller 120, so that the impeller 120 can be rotated while maintaining a gap between the impeller 120 and the shroud 130.

Specifically, an operation of the regulator and a flow of the fluid when the impeller 120 is driven will be described below.

First, when the impeller 120 is driven, as the fluid is suctioned through the suction port 131 of the centrifugal compressor, a pressure in the space formed adjacent to the other surface 122 of the impeller 122 is increased.

In addition, a small gap is formed between the circumferential end of the impeller 120 and the shroud 130 surrounding the end. The fluid having a pressure increased by the centrifugal force of the impeller 120 through the gap is continuously introduced into the space formed adjacent to the other surface 122 of the impeller 120 in the arrow direction.

Therefore, when a certain pressure or more is introduced into the space formed adjacent to the other surface 122 of the impeller 120, the regulator 150 is operated as a discharge mode to discharge the pressure in the space formed adjacent to the other surface 122 of the impeller 120 to the outside in the arrow direction.

As a result, a pressure that can displace the impeller 120 is not formed in the space adjacent to the other surface 122 of the impeller 120, and thus, the impeller 120 can be rotated while maintaining a certain gap between the impeller 120 and the shroud 130.

As described above, as the impeller 120 is rotated, most of the fluid at the suction port 131 of the centrifugal compressor is suctioned toward the one surface 121 of the impeller 120 to be compressed and discharged to the volute chamber 140. At this time, some of the fluid introduced toward a circumferential edge of the one surface 121 of the impeller 120 is continuously introduced toward the other surface 122 of the impeller 120 through the gap between the end of the impeller 120 and the shroud 130 and then discharged through the regulator 150, enabling control of the axial thrust force.

Therefore, since the space adjacent to the other surface 122 disposed in the front of the impeller 120 is in selective communication with the outside, a difference in pressure between the one surface 121 and the other surface 122 of the impeller 120 can be regulated to minimize generation of the axial thrust force. As a result, operation efficiency of the compressor can be remarkably improved.

Figure 2:
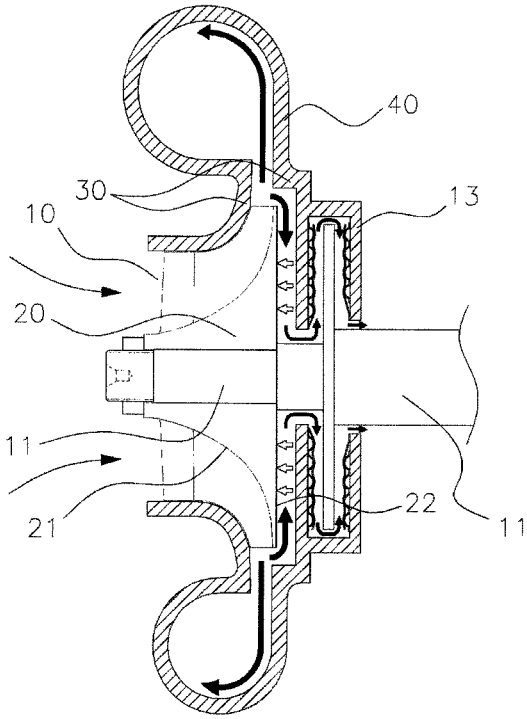
FIG. 2 is a side cross-sectional view of the conventional centrifugal compressor.
Figure 3:
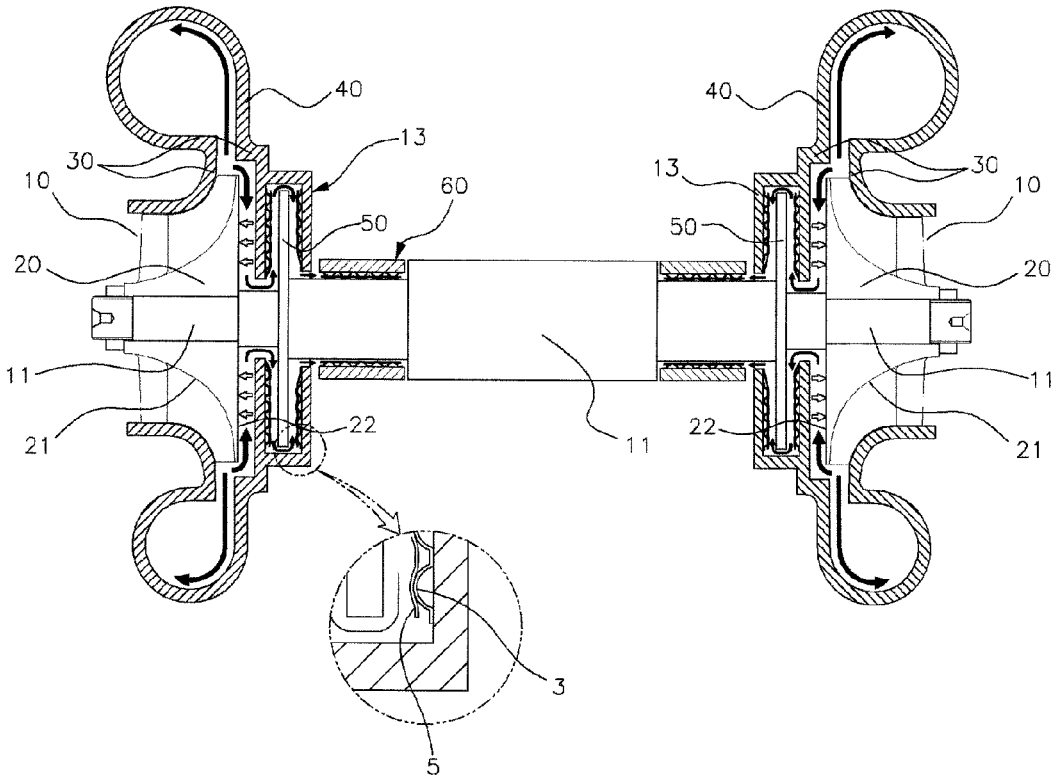
FIG. 3 is a side cross-sectional view of another conventional centrifugal compressor.

Moreover, as the regulator 150 is provided, generation of the axial thrust force described with reference to FIGS. 1 and 2 can be removed, and contact resistance according to rotation of the impeller 120 is minimized, and thus the entire operation performance of the centrifugal compressor can be improved.

As a result, in comparison with removal of the axial thrust force through communication of the space adjacent to the other surface 122 of the impeller 120 with the outside, discharge of the fluid having the increased pressure to the outside can be minimized to minimize energy loss, effectively controlling the axial thrust force.

Specifically, the discharge operation of the regulator 150 may be performed when a pressure for maintaining a clearance between the impeller 120 and the shroud 130 is a set pressure or more. Here, the clearance is a small gap between the impeller 120 and the shroud 130, which may be slightly varied according to the pressure in the space formed adjacent to the other surface 122 of the impeller 120.

In addition, the set pressure for maintaining the clearance between the impeller 120 and the shroud 130 is a value set to perform the discharge operation, i.e., a minimal pressure introduced into the space formed adjacent to the other surface 122 of the impeller 120 to displace the impeller 120.

Therefore, the regulator 150 performs the discharge operation when the pressure is the set pressure or more. Since the set pressure is a pressure immediately before displacement of the impeller 120, the impeller 120 can be rotated through the regulator 150 while maintaining a certain gap between the impeller 120 and the shroud 130.

Meanwhile, the regulator 150 may be disposed at one side of the shroud 130 straightly extending in an axial direction of the impeller 120 to discharge the fluid suctioned around the rotary shaft 110, in which a pressure is increased by the centrifugal force, and rotated by inertia and partially introduced into the space formed adjacent to the other surface 122 of the impeller 122.

Specifically, as the impeller 120 is rotated, the fluid introduced through the gap between the circumferential end of the impeller 120 and the shroud 130 surrounding the end is rotated in the circumferential direction of the impeller 120 by the centrifugal force, and introduced into the space formed adjacent to the other surface 122 of the impeller 120.

Therefore, as the regulator 150 is disposed at a rear surface of the impeller 120, the fluid can be smoothly discharged due to a difference in pressure, and a uniform vortex of an air flow is formed to minimize influence on the impeller 120 upon the discharge operation.

As a result, the influence on the impeller 120 upon the discharge operation of the regulator 150 can be minimized to more stably operate the centrifugal compressor.

Meanwhile, as shown, the regulator 150 may be coupled to a rear surface of the shroud 130 through an open portion.

Specifically, the regulator 150 may include a base 151, a valve body 153, and a spring 155. The base 151 has a passage 132 in communication with an inner space of the shroud 130, and the valve body 153 is disposed in the passage 132 to be resiliently supported. Here, an outer region of the base 151, excluding a portion for supporting the spring 155, is opened.

Therefore, when the passage 132 is opened by the valve body 153, the space adjacent to the other surface of the impeller 120 may be in communication with the outside through the passage 132 and the open portion of the valve body 151.

Here, the end of the base 151 may have a cylindrical sleeve shape threadedly engaged with the open portion of the shroud 130. The passage 132 through which the fluid can pass is formed inside the end of the base 151. The passage 132 may have a cylindrical shape. A step portion from the end of the base 151 may be adhered to an outer surface of the shroud 130, and a packing member (not shown) may be further provided to seal the step portion to perform a smooth discharge operation.

In addition, a portion outwardly extending from the step portion of the base 151 is constituted by linear frames, and an open portion in communication with the outside is formed between the linear frames.

Therefore, the fluid introduced through the passage 132 is discharged to the outside through the open portion. At this time, the fluid is selectively discharged by the valve body 153 installed on the passage 132.

The valve body 153 has a cylindrical shape and includes a flange formed at its end. The valve body 153 is inserted into the passage 132 such that the flange is hooked by the step portion of the base 151. The spring 155 configured to resiliently support the valve body 153 is connected to a center of an end of the flange.

The spring 155 is disposed between the valve body 153 and an outer end of the base 151. An adjustment bolt 157 is installed at the outer end of the base 151 to pass through a portion extending from the valve body 153 along a centerline thereof to be threadedly engaged with the portion.

Therefore, one end of the spring 155 may be coupled to the adjustment bolt 157 and the other end of the spring 155 may be coupled to the valve body 153 to apply a contraction force such that the valve body 153 moves toward a center of the base 151. At this time, a resilient support force of the spring 155 is adjusted to open the valve body 153 to maintain the clearance between the impeller and the shroud and control the axial thrust force upon rotation, when a pressure in the space is the set pressure or more.

Specifically, since the contraction force generated by the spring 155 is not deflected but normally applied toward a center of the valve body 152, the valve body 153 can be moved without shaking and twisting. The spring 155 may be variously coupled to apply the contraction force toward the center of the valve body 152.

Here, the threadedly engaged adjustment bolt 157 can be rotated to move in the axial direction of the base 151, and resilience of the spring 155 can be adjusted by varying the distance. A fixing nut may also be provided to increase a fastening force of the adjustment bolt 157.

Meanwhile, describing the operation of the regulator 150, when the fluid having a predetermined pressure or more is introduced into the space adjacent to the other surface 122 of the impeller 120, the fluid is discharged to the passage 132.

That is, when the pressure of the fluid is equal to or larger than the contraction force of the spring 155, the fluid pushes the valve body 153 such that the valve body 153 can be spaced apart from the base 151 and the passage 132 is opened, and thus the fluid can move to the outside.

In addition, when the regulator 150 having the above configuration is applied in the space adjacent to the other surface 122 of the impeller 120, into which the fluid having the increased pressure is introduced and the pressure formed in the shroud 130 is increased to a tension of the spring 155 or more, the valve body 153 is spaced apart from the base 151 to open the passage 132 and discharge the fluid in the shroud 130 to the outside, removing the axial thrust force to push the impeller 120.

As described above, the centrifugal compressor in accordance with the present invention does not discharge the pressurized air to the outside until the pressure reaches a predetermined set pressure through tension adjustment of the spring 155 upon the operation. When it reaches the set pressure, the valve body 153 is moved and the passage 132 is opened to discharge the fluid to the outside and remove the axial thrust force, and thus, the impeller 120 can be rotated without contact with the shroud 130.

As a result, since the clearance between the impeller 120 and the shroud 130 upon rotation can be uniformly maintained, frictions and vibrations due to impacts can be prevented to remarkably improve durability.

Figure 6:
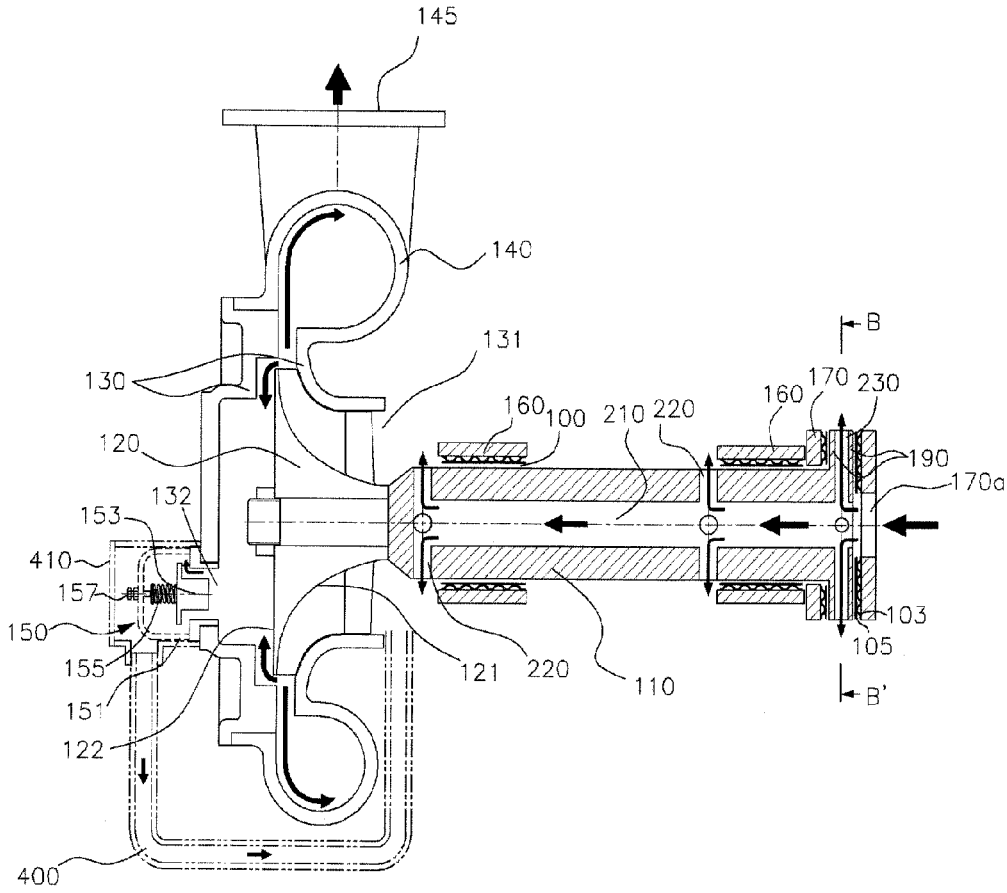
FIG. 6 is a side cross-sectional view of a centrifugal compressor in accordance with another exemplary embodiment of the present invention.
Figure 7:
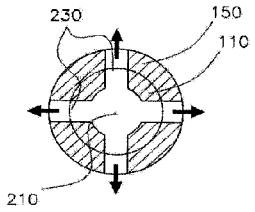
FIG. 7 is a cross-sectional view taken along line B-B' of FIG. 6.

Meanwhile, FIG. 6 is a side cross-sectional view of a centrifugal compressor in accordance with another exemplary embodiment of the present invention, and FIG. 7 is a cross-sectional view taken along line B-B' of FIG. 6. Basic configuration of the embodiment is the same as the above-mentioned embodiment, and thus, detailed description thereof will not be repeated.

The centrifugal compressor in accordance with the present exemplary embodiment effectively controls the axial thrust force using the regulator 150 to provide operation performance appropriate to high speed rotation and durability through a one-side suction method, and further includes a cooling structure.

As shown in FIG. 6, a pipe connection part 410 is installed at an outside of the regulator 150, and a separate collecting pipe 400 is connected to the pipe connection part 410 to be communicated therewith.

Therefore, when the passage 132 is opened by the valve body 153 of the regulator 151, the space adjacent to the other surface 122 of the impeller 120 is opened such that the fluid can be introduced into the collecting pipe 400 through the passage 132. Specifically, as shown in FIG. 6, the regulator 150 may be connected to the collecting pipe 400 configured to discharge the fluid partially introduced into the space adjacent to the other surface 122 of the impeller 120 toward the one surface 121 of the impeller 120 again upon rotation thereof.

The pipe 400 may be radially provided in plural in the circumferential direction of the shroud 130 at predetermined intervals, and angles of the pipes 400 connected to the one surface of the impeller 120 may be adjusted to improve performance of the centrifugal compressor.

Meanwhile, the centrifugal compressor in accordance with the present exemplary embodiment includes a rotary shaft 110, an impeller 120, a thrust bearing disk 190, gas bearings 160 and 170, and a thrust cooling flow path 230. Here, the centrifugal compressor performs a self-cooling operation through rotation of the rotary shaft 110 such that an increase in viscosity of the fluid due to an increase in temperature of an ambient gas of the gas bearings disposed around the centrifugal compressor can be suppressed to a minimum level using an external cooling air introduced through a main flow path 210, a branch flow path 220 and the thrust cooling flow path 230.

As described above, in order to prevent eccentric rotation of the impeller 120 due to the axial thrust force generated upon rotation of the impeller 120, the thrust bearing disk 190 may be integrally formed with the other end of the rotary shaft 110. Accordingly, in order to minimize shaking due to rotation of the rotary shaft 110, a rotation balance between the rotary shaft 110 and the impeller 120 may be needed.

Moreover, a suction port opened at a center of one side of the shroud 130 and suctioning a fluid is formed around the rotary shaft 110 to change a suction direction to be different from the conventional centrifugal compressor, preventing a high temperature fluid having an increased pressure from being introduced into the gas bearings 160 and 170 and accelerating an increase in temperature.

Meanwhile, in the present invention, in order to minimize friction due to rotation of the rotary shaft 110 to enable high speed rotation thereof, an oil-less gas bearing using a gas is used to form an oil film or a lubrication film.

For this, the gas bearing may use a bump-type air foil including a bump foil 103 disposed inside a cylindrical support case to form an entirely circular shape and having a plurality of rounded curved parts projecting toward the rotary shaft, and a top foil 105 disposed inside the bump foil 103 to contact the rotary shaft 110. Accordingly, such a bump-type air foil bearing has a small friction load when the rotary shaft moves or stops, and good spring rigidity for supporting the rotary shaft when stopping.

As described above, when the rotary shaft 110 is rotated at a high speed, a dynamic pressure is formed in a space between the foils and the rotary shaft 110 due to an air flow. The foils are resiliently deformed in a direction away from the rotary shaft by the dynamic pressure, and an air gap 100 is formed between the rotary shaft and the foils so that the rotary shaft can be rotated without friction with the foils.

In addition, the gas bearings include radial bearings 160 installed at an outer surface of the rotary shaft 110 and supporting both ends of the rotary shaft 110 in an axial direction thereof, and a thrust bearing 170 for supporting the thrust bearing disk 190.

Meanwhile, in the conventional art, the axial thrust force is generated in the space formed at the other surface 122 due to a difference in pressure between the one surface 121 and the other surface 122 of the impeller 120. The axial thrust force generates friction from the thrust bearing, which supports the rotary shaft in the axial direction, to increase a temperature thereof. Under such temperature increase conditions, unlike liquid, as the temperature is increased, a viscosity coefficient of the gas of the air gap is increased to increase a shearing stress. As a result, the friction is also increased to abruptly increase the temperature, and thus, the support performance of the gas bearings is decreased.

Therefore, in order to effectively cool the interior of the centrifugal compressor in accordance with the present invention by cooling the rotary shaft 110 and the gas bearings 160 and 170 to improve the support performance of the gas bearings, a thrust cooling flow path 230 is formed in the thrust bearing disk 190 in the radial direction to introduce a fluid from the outside.

Referring to FIG. 7, the thrust cooling flow path 230 is branched into at least one path, and one end of the branched flow path 220 is in communication with the main flow path 210, and the other end is disposed to pass through the gas bearing. Here, the gas bearing refers to the thrust bearing 170 installed to surround the thrust bearing disk 190. Accordingly, the inside of the thrust bearing disk 190 can be cooled as the rotary shaft 110 is rotated.

In addition, the main flow path 210 passes through the end of the rotary shaft 110 to be in communication with a through-hole 170*a* of the thrust bearing 170 installed in the circumferential direction, and at least one branch flow path 220 branched from the main flow path 210 may be formed to pass through the outer circumference of the rotary shaft 110 adjacent to the end of the radial bearing 160.

Specifically, a flow of the fluid formed in the centrifugal compressor will be described below.

The fluid outside the centrifugal compressor is introduced through the through-hole 170*a* formed to pass through the thrust bearing 170. The fluid introduced as described above effectively cools the gas bearing and ambient gas using a cooling operation and thermal conductivity to the centrifugal compressor.

First, some of the introduced fluid is introduced into the thrust cooling flow path 230 inside the thrust bearing disk 190 via the main flow path 210 to cool the thrust bearing disk 190, and then, discharged to the outside along a flow path passing through the thrust bearing 170.

In addition, the remaining fluid is ejected toward the end of the radial bearing 160 through the branch flow path 220 connected to the main flow path 210 to cool the rotary shaft 110 and the radial bearing 160. As a result, the air gap 100 of the radial bearing 160 can be maintained.

The fluid discharged to the outside through the thrust cooling flow path 230 and the branch flow path 220 is moved toward the suction port 131 of the rotating impeller 210 to be ejected through an ejection port 145 at a pressure increased by the centrifugal force.

Therefore, a high temperature of heat generated in the centrifugal compressor is discharged to the outside of the centrifugal compressor through the flow of the above-mentioned fluid to effectively cool the thrust bearing disk 190 as well as the rotary shaft 110. In addition, as the rotary shaft 110 is cooled, the thrust bearing disk 190 adhered to the outer circumference of the rotary shaft 110, the radial bearing 160 and the thrust bearing 170 can also be cooled to effectively cool the inside of the centrifugal compressor.

Specifically, unlike a liquid lubricant, since viscosity of a general gas is increased as the temperature is increased, by cooling the gas used to form the oil film or lubrication film of each bearing, an increase in viscosity of the gas can be suppressed and thus rotation support capability can be remarkably improved. As described above, it is experimentally confirmed that the rotation support capability can be improved, the concave and convex portions affected by the top foil and the bump foil can be removed to increase flatness, and thus, ultra-high speed rotation support performance can be remarkably improved by three times or more compared to that of the conventional art.

That is, since lubrication performance according to cooling of the gas is maintained, the top foil is flattened and does not form the concave and convex portions affected by the bump foil, increasing the thickness and strength thereof. As a result, as a smooth gas-oil film can be stably formed and the concave and convex portions can be minimized, a boundary oil film can be maximally enlarged to remarkably improve the rotation support capability.

As described above, the self-cooling in which rotation and cooling of the rotary shaft 110 are simultaneously performed is possible, and an increase in temperature of the gas bearings 160 and 170 such as the radial bearing and the thrust bearing can be suppressed to improve the support performance of the gas bearings 160 and 170. In addition, since the thrust bearing 170 having the improved support performance can stably absorb a force applied in the axial direction of the impeller to provide strong rotation support capability that can control the axial thrust force, it is possible to effectively remove a surging phenomenon without a separate BOV.

Meanwhile, the thrust cooling flow path 230 may have a diameter smaller than that of the main flow path 210 and may be radially disposed around the rotary shaft 110 at predetermined intervals.

Here, the reason that the diameter of the thrust cooling flow path 230 is smaller than that of the main flow path 210 is to provide an acceleration structure to cause a smooth flow of the fluid. That is, the fluid discharged through the main flow path 210 and the thrust cooling flow path 230 is suctioned through the suction port 131 of the impeller 120. and discharged. In addition, a diameter of the branch flow path 220 may also be smaller than that of the main flow path 210.

Here, discharge ports of the branch flow path 220 and the thrust cooling flow path 230 are disposed adjacent to the radial bearing 160 and the thrust bearing 170 installed at the outer circumference of the rotary shaft, respectively. As a result, the air discharged through the discharge ports at a high speed can accelerate introduction and discharge of the gas forming the oil film of the gas bearings 160 and 170 such as the radial bearing and the thrust bearing by a Venturi effect. In addition, the cooling operation in this process can suppress an increase in viscosity of the gas, which forms the oil film, to improve the rotation support performance.

Further, one or more of the thrust cooling flow path 230 may be radially formed inside the thrust bearing disk 190 at predetermined intervals, and may be perpendicularly branched from the main flow path 210. As a result, the centrifugal force is applied to the thrust cooling flow path 230 to the largest level due to rotation of the rotary shaft 110, performing a smoother flow of the fluid.

As described above, a discharge space of the cooling flow path may be in communication with the suction port 131 of the impeller 120. For this, a casing (not shown) surrounding the rotary shaft 110 and having one end in communication with the suction port 131 may be installed outside the thrust cooling flow path 230.

Specifically, since the outside of the gas bearings 160 and 170 is covered by the casing (not shown), the inner space covered as described above functions as a moving flow path of the fluid. In addition, as the suction port 131 is formed around the rotary shaft 110, the fluid discharged through the branch flow path 220 and the thrust cooling flow path 230 and having heat is moved toward the suction port 131 by the suction force according to the rotation of the impeller 120 to be discharged to the outside through the ejection port 145.

In order to perform a smoother flow of the fluid, the branch flow path 220 and the thrust cooling flow path 230 formed in the same number as the installed radial bearings 160 has smaller passage diameters away from the impeller 120.

As a result, as the fluid discharged through the cooling flow path is smoothly moved toward the impeller, the flow of the cooling fluid becomes smoother and the high temperature fluid can be rapidly discharged to the outside, remarkably improving durability of the centrifugal compressor.

Figure 8:
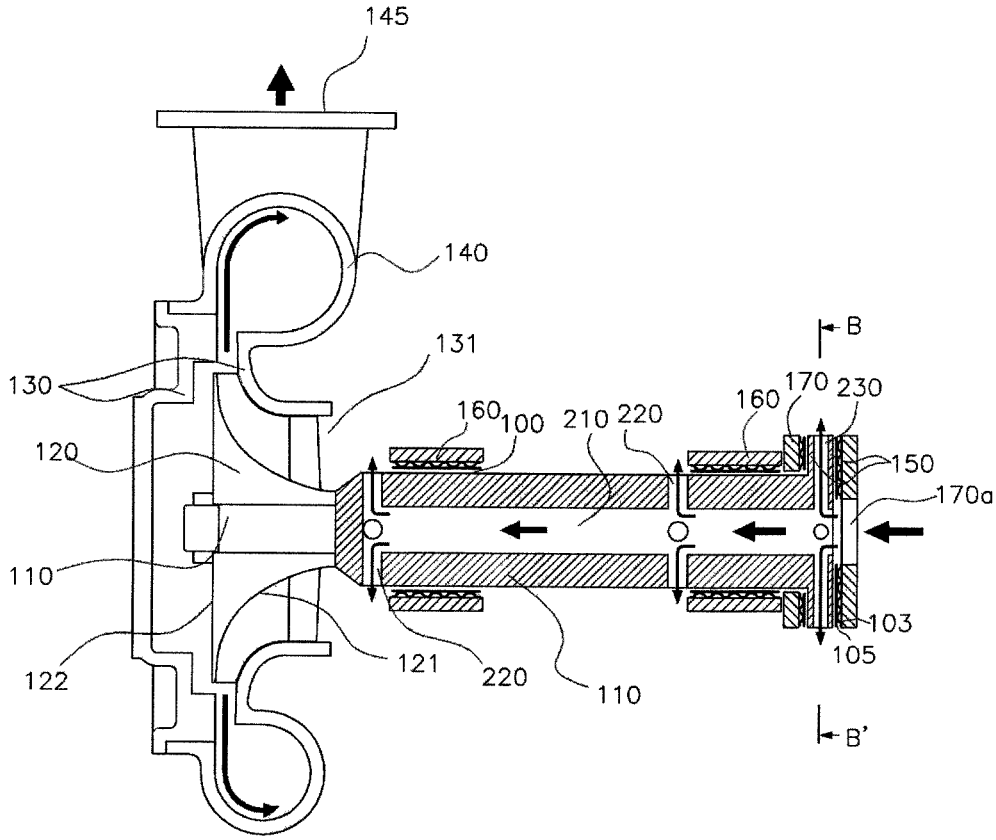
FIG. 8 is a side cross-sectional view of a modified example of the centrifugal compressor in accordance with another exemplary embodiment of the present invention.

Meanwhile, FIG. 8 is a side cross-sectional view of a modified example of the centrifugal compressor in accordance with another exemplary embodiment of the present invention.

As shown in FIG. 8, the cooling flow path including the main flow path 210, the branch flow path 220 and the thrust cooling flow path 230 may be applied to the centrifugal compressor not having the regulator 150 and the collecting pipe 400.

While the invention has been shown and described with reference to certain example embodiments thereof, it will be understood by those skilled in the art that various changes in form and details may be made therein without departing from the spirit and scope of the invention as defined by the appended claims

What is claimed is:

1. A centrifugal compressor comprising:

an impeller connected to a rotary shaft and configured to radially eject a fluid suctioned in an axial direction upon rotation thereof;

a shroud configured to cover front and rear surfaces of the impeller and having a suction port formed to face the front surface of the impeller at a center of a first side thereof;

a volute chamber formed at an outer periphery of the shroud in a circumferential direction thereof and configured to guide the fluid ejected by the impeller to an ejection port; and a regulator installed at a second side of the shroud which faces the rear surface of the impeller and configured to open a passage between an outside of the shroud and a space formed between the rear surface of the impeller and the second side of the shroud, wherein the regulator comprises, a base coupled to the second side of the shroud, wherein a step portion from one end of the base is attached to the second side of the shroud, and an outwardly extended portion of the step portion of the base has an open portion being communicated with an outside of the base, a valve body disposed inside the base and configured to selectively open/close the passage, wherein the passage is open by the valve body moving toward a center of the base when a pressure in the space is higher than a pre-set pressure so that the regulator relieves an axial thrust force applied to the rotary shaft by the pressure in the space, a spring installed between the base and the valve body and configured to resiliently support the valve body to selectively close the passage, and a adjustment bolt installed at an outer end of the base through a portion extending from the valve body, wherein one end of the spring is coupled to the adjustment bolt.

2. The centrifugal compressor according to claim 1, wherein the spring has a resilient support force that is adjusted to open the valve body when the pressure in the space is higher than the pre-set pressure such that a clearance between the rear surface of the impeller and the second side of the shroud is maintained upon rotation of the impeller.

3. The centrifugal compressor according to claim 1, wherein the regulator is connected to a collecting pipe to discharge a part of the fluid which is discharged from the space through the passage when the passage is open by the valve body moving toward the center of the base.

4. The centrifugal compressor according to claim 1, wherein one end of the rotary shaft includes a thrust bearing disk for keeping a rotation balance with the impeller, wherein a main flow path and a thrust cooling flow path in communication with each other are formed in the rotary shaft and the inside of the thrust bearing disk.

* * * * *